United States Patent [19]

Fornadel et al.

[11] Patent Number: 4,789,424

[45] Date of Patent: Dec. 6, 1988

[54] APPARATUS AND PROCESS FOR OPTIC POLISHING

[76] Inventors: Frank Fornadel, 407 Nixon Ave., Bayville, N.J. 08721; George Clement, 4 Paderewski Dr., Oak Ridge, N.J. 07438

[21] Appl. No.: 131,727

[22] Filed: Dec. 11, 1987

[51] Int. Cl.[4] ..... B44C 1/22; B24B 1/00; B24B 7/19; B24B 7/30

[52] U.S. Cl. ..... 156/637; 51/216 LP; 51/216 T; 51/284 R; 156/639; 156/645; 156/663; 156/345

[58] Field of Search ..... 156/636, 637–639, 156/641, 645–654, 663, 903, 345; 51/281 R, 317, 284 R, 204, 209 R, 209 DL, 216 LP, 216 T

[56] References Cited

U.S. PATENT DOCUMENTS

| | | | |
|---|---|---|---|
| 2,328,533 | 8/1943 | Walker | 156/639 |
| 2,372,535 | 3/1945 | Walker | 156/638 X |
| 2,384,638 | 9/1945 | Penberthy | 156/639 X |
| 4,588,473 | 5/1986 | Hisatomi et al. | 156/639 X |

*Primary Examiner*—William A. Powell
*Attorney, Agent, or Firm*—Clifford G. Frayne, Esq.

[57] ABSTRACT

There is disclosed a novel method and apparatus for automatic optic polishing. The apparatus includes a spindle arm rotatable and transversely displaceable which has removably secured thereto a cross hatched, radially cut pitch lap in contact with the optic to be polished, the pitch lap being transversely displaced across the optic while simultaneously rotating in a direction opposite to the direction in which the optic is rotated. The cross hatched radially cut pitch lap transported across the optic in the manner prescribed while submerged in a polishing compound results in an optic surface having a better than one-tenth wave deviation.

9 Claims, 2 Drawing Sheets

APPARATUS AND PROCESS FOR OPTIC POLISHING

FIELD OF INVENTION

This invention relates to an improved apparatus and process for compounding and polishing flat and spherical lens and mirror surfaces and, more particularly, to and improved apparatus and process for same.

BACKGROUND OF INVENTION

Mirror and lenses utilized in optical equipment and scientific equipment require the surfaces to be finished to a very narrow range of tolerances in order that the lens or mirror can repeatedly function in an accurate manner over a period of time. Lenses and mirrors utilized in optical equipment are designed to focus light rays on the particular spot for viewing by the operator. Lenses and mirrors utilized in scientific equipment must have the capability of focusing or dispersing light rays in an identical pattern over the useful life of the scientific apparatus. The polishing of lenses and mirrors to achieve the tolerances required was once considered an art and not a science and was performed by practitioners who devoted their life to the hand polishing, compounding and finishing of lenses and mirrors.

In recent times, mechanical devices have become available which aid in the componding and finishing of lenses and mirrors; however, there has been a need for a machine which could automatically achieve the tolerances desired and which could operate in a relatively automatic mode with the compounding material such that an operator could operate several machines at one time and thus increase the productivity in the production of lenses and mirrors. Such a machine requires not only mechanical accuracy, but the correct compounding material and compounding material design in order that an operator, who may not be a skilled practitioner in the process of lens and mirror compounding, can operate the machine with the anticipated result that the finished mirror will have the desired surface accuracy.

The accuracy of the mirrors and lenses are measured by a wavelength. The wavelength of light is measured in angstroms with one angstrom equaling 0.00000116 inches at a specific wavelength. In a perfect sphere, there would be no deviation and all light being reflected from it would be focused on a single point called a defraction spot. A perfect sphere is practically impossible to achieve and, therefore, the deviation of the mirror is measured in wavelengths or "waves". For example, a 1/10 wave mirror refers to the surface and how it deviates from a true sphere. A typical mirror for an optical telescope requires a tolerance of ⅛ wave.

The apparatus and process disclosed herein permits the operator to achieve a surface accuracy of at least 1/10 wave by means of the mechanical apparatus in combination with the compounding material and the design of the compounding material in contact with the lens or mirror surface.

OBJECTS OF THE INVENTION

An object of the present invention is to provide a novel apparatus and process for automatically polishing lenses and mirrors to a tolerance of better than 1/10 wave.

A further object of the present invention is to provide a novel apparatus and process which can be operated with little or no operator supervision.

A still further object of the present invention is to provide a novel apparatus and process which can achieve repeated tolerance levels for lenses and mirrors.

A still further object of the present invention is to provide a novel lap compound designed for polishing lenses and mirrors.

SUMMARY OF THE INVENTION

These and other objects of the present invention are achieved by a polishing assembly comprising a first spindle arm, ball socket and handle frictionally secured to a support having the pitch lap secured to the support, the pitch lap having first had cross hatched indentations compressed therein, pitch lap also being radially cut from its center to its circumferential edge, the pitch lap in contact with the spherical substrate to be polished, the spherical substrate supported in a housing filled with polishing compounds such that the spherical substrate rotates in one direction while the pitch lap rotates in the opposite direction with the first spindle arm moving the pitch lap radially across the spherical substrate.

BRIEF DESCRIPTION OF THE DRAWINGS

A better understanding of the present invention as well as other objects and advantages thereof will become apparent upon consideration of the detailed disclosure thereof, especially when taken with the accompanying drawings wherein.

DETAILED DESCRIPTION OF THE DRAWINGS

Figure 1:
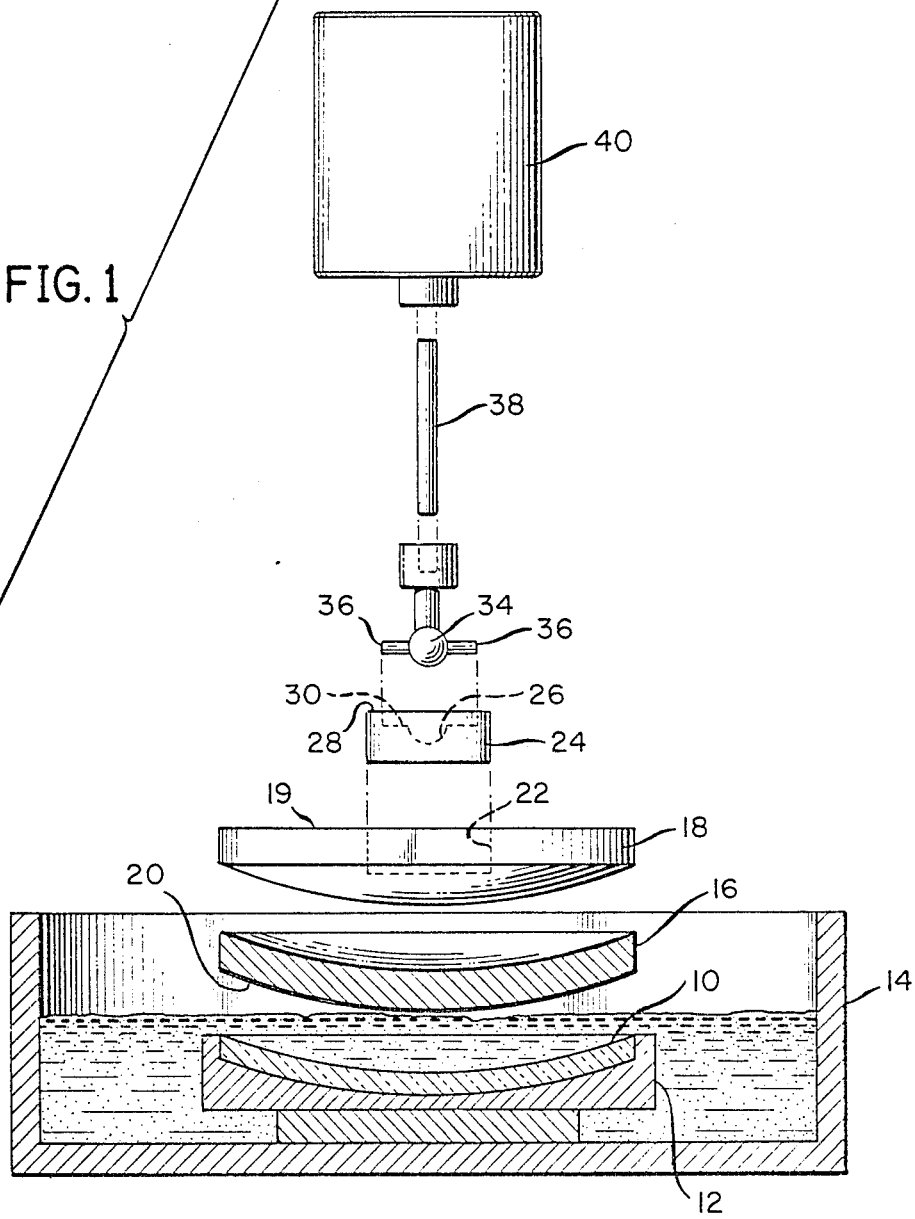
FIG. 1 is a side elevational partial cutaway view of the optic polishing apparatus.

Considering FIG. 1, there is shown an exploded side elevational view of the apparatus and the lap as it would be assembled for operation on a mirror, lens or optic surface.

The optic 10 is positioned on a support plate 12, within a container vessel 14. The optic 10 is submerged in a polishing compound in container vessel 14. Once the optic 10 is positioned on support plate 12 and submerged in the polishing compound, the polishing apparatus and the pitch lap are assembled on the upper surface of optic 10.

The pitch lap 16 is positioned on support 18 such that pitch lap surface 20 which constitutes the polishing surface, faces downwardly and is in contact with the optic 10 and the surface to be polished. The upper surface 19 of support 18 has an indentation 22 which coincides with the dimensions of handle 24 thus permitting handle 24 to be inserted into indentation 22. This permits the rotation of support 18 and pitch lap 16 as which will be more fully described hereafter.

Handle 24, similarly has an indent 26 in its upper surface 28. This indent is semi-circular in configuration having two longitudinal arms 30 extending outwardly therefrom. This indent is for receipt of ball socket 34 which is circular in cross section area and has two lateral arms 36 extending outwardly therefrom. In this configuration, a portion of ball socket 34, together with lateral arms, 36, engage indent 26 and longitudinal depressions 30. Ball socket 34 is removably secured to a shaft arm 38 which in turn is secured to a motor means 40.

In this configuration, shaft arm 38, ball socket 34, in cooperation with handle 24 and support 18 cause the rotation of pitch lap 16 on the surface of optic 10. Additionally, the shaft arm 38 secured to motor 40 while not only rotating above its vertical axis, is also caused to move in a vertical plane thus causing pitch lap 16 to move in a stroke motion across optic 10 while rotating. Still additionally, container vessel 14, together with support 12 and lens or mirror 10 are positioned and capable of rotating in a counter direction to the rotation of pitch lap 16.

Figure 2:
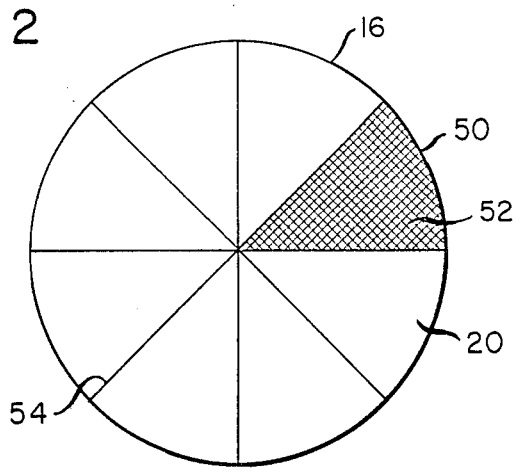
FIG. 2 is a top elevational view of the optic polishing apparatus.
Figure 3:
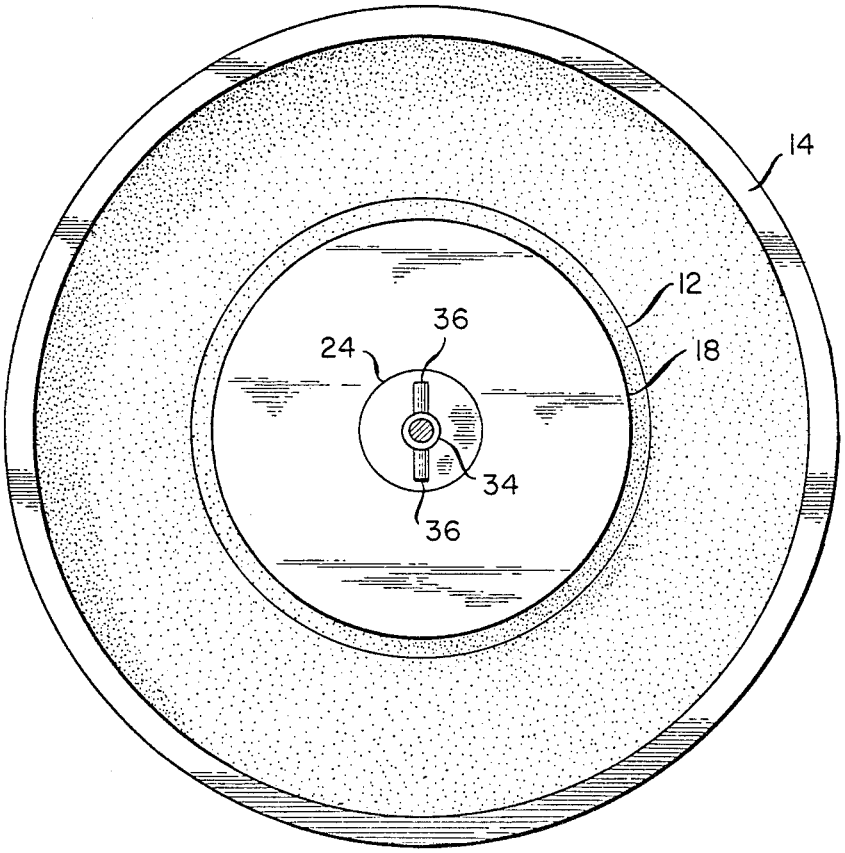
FIG. 3 is a top planer view of the pitch lap.

Referring to FIG. 2, there is shown a top planer view of the pitch lap utilized in Applicant's process. The pitch lap 16 is prepared by pressing it on the face of the optic to be polished to achieve the necessary shape. In the pressing process, a plastic screen 50 is positioned between the pitch lap and the optic in order to impart a cross-hatched surface 52 to the pitch lap. Once the plastic screen 50 has imparted the cross-hatching to the pitch lap, the pitch lap is removed from the optic and cut radially in a pie-shaped fashion 54 radially from the center of the lap to the edge. In practices, it has been found that eight cuts provide the optimum surface for polishing and these cuts differ from the normal square cuts used in the art to date.

The pitch lap 16 is then pressed against the front surface of the optic to be polished and weight is applied to the pitch lap for approximately thirty minutes. The weight is then removed and the apparatus is assembled as shown in FIG. 1.

Through experimentation, it has been found, that with respect to the apparatus and the pitch lap as disclosed herein, the following parameters offer the best results: the stroke length of the upper arm of the polishing machine should be set to one-third the diameter of the optic and the speed of the upper arm should be set to about twenty to twenty-five strokes per minute. The lower spindle is set to rotate in the container vessel 14 and polishing compound at approximately one to fifteen revolutions per minute while the pitch lap while stroking at ten to twenty-five strokes per minute is rotated at approximately three-quarter revolutions per minute.

The pitch lap utilized is the preference of the operator; however, Applicants have obtained best results through the use of Zobels (brand name) using a six to one ratio of soft mix to hard mix. This ratio, however, may vary and must be determined experimentally as the consistency of the pitch mix varies from batch to batch.

Similarly, the choice of polishing compound is one of preference to the operator. Applicants have obtained best results using Barnesite (brand name) or TK68 (brand name) polishing compounds.

Applicants have found that preparing the pitch lap in the manner described utilizing that pitch lap with the above-identified apparatus according to the parameters set forth herein permits them to repeatedly obtain an optic with the achieved wavelength deviation set forth herein.

While the present invention has been described in connection with the exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. A method of polishing spherical and flat optics to better than one/ten wave surface comprising:

forming a pitch lap to the configuration of said optic;

positioning a cross hatched nonabrasive screen between said pitch lap and said optic;

compressing said pitch lap onto said optic to impart cross hatched indentations on said pitch lap;

removing said cross hatched plastic screen;

cutting said pitch lap radially from the center to the edge with a plurality of cuts;

positioning said cross hatched surface of said pitch lap against said optic;

submerging said optic and said pitch lap in a polishing compound;

securing said pitch lap to a stroke spindle;

displacing said pitch lap laterally across said optic by means of said stroke spindle;

simultaneously rotating said pitch lap;

simultaneously rotating said optic in a direction opposite to rotation of said pitch lap.

2. A method as defined in claim 1 wherein said displacement distance of said pitch lap and said stroke spindle across said optic is one-third the diameter of said optic.

3. A method as defined in claim 1 wherein said displacement of said pitch lap and said stroke spindle of said optic is repeated in the range of ten to twenty-five strokes per minute.

4. A method as defined in claim 1 wherein said pitch lap is rotated on said stroke spindle in a range of one-half to one and a half revolutions per minute.

5. A method as defined in claim 1 wherein said optic is rotated in a range of from one to fifteen revolutions per minute.

6. An apparatus for automatically polishing optics comprising:

a spindle arm rotatable about its axis and transversely displaceable;

means for rotating said spindle arm and transversely displacing said spindle arm;

a ball socket removably secured to said upper spindle arm;

a handle, frictionally engageable with said ball socket and frictionally engageable with a supporting means;

a cross hatched, radially cut pitch lap interposed between said support means and said optic;

a housing means supporting said optic, said housing means rotatable with said optic and said housing means containing a polishing compound.

7. An apparatus in accordance with claim 6, wherein said pitch lap and said housing means rotate in opposing directions.

8. An apparatus in accordance with claim 6, wherein said spindle arm and said pitch lap are transversely displaced approximately one-third the diameter of the optic.

9. An apparatus in accordance with claim 6, wherein said pitch lap contains eight radial cuts

* * * * *